United States Patent [19]

Bosch et al.

[11] 4,369,567

[45] Jan. 25, 1983

[54] METHOD OF MANUFACTURING A PERMANENT MAGNET WHICH IS TO BE ARRANGED IN AN AIR GAP OF A TRANSFORMER CORE

[75] Inventors: Gerrit Bosch; Arnoldus W. Kok; Harmen Giethoorn, all of Eindhoven, Netherlands

[73] Assignee: U.S. Philips Corporation, New York, N.Y.

[21] Appl. No.: 185,842

[22] Filed: Sep. 10, 1980

[30] Foreign Application Priority Data

Sep. 25, 1979 [NL] Netherlands ..... 7907115

[51] Int. Cl.[3] ..... B65B 61/24; B26F 3/00; H01F 7/00; H01F 7/02

[52] U.S. Cl. ..... 29/607; 225/97; 53/121; 53/435; 335/229; 335/306; 241/283; 29/412

[58] Field of Search ..... 29/602, 607, 608, 412, 29/413; 225/1-5, 97, 103; 335/297, 303, 306, 302; 53/435, 121; 241/235, 236, 283, 242

[56] References Cited

U.S. PATENT DOCUMENTS

| | | | |
|---|---|---|---|
| 2,325,832 | 8/1943 | Christensen | 29/607 |
| 3,396,452 | 8/1968 | Sato et al. | 53/435 X |
| 3,480,189 | 11/1969 | Topolski et al. | 225/97 X |
| 3,534,912 | 10/1970 | Brown | 241/242 X |
| 3,562,057 | 2/1971 | McAlister et al. | 53/435 X |
| 3,562,058 | 2/1971 | Boyd | 53/435 X |

FOREIGN PATENT DOCUMENTS

| | | | |
|---|---|---|---|
| 2424131 | 5/1974 | Fed. Rep. of Germany | 29/607 |

*Primary Examiner*—Lowell A. Larson

*Attorney, Agent, or Firm*—Robert T. Mayer; Bernard Franzblau

[57] ABSTRACT

A method of manufacturing a plate-shaped permanent magnet (7) which is to be arranged in an air gap of a core (1) for a transformer or choke coil and which consists of a number of permanent magnetic portions (29) which are made of a metal alloy having a high magnetic remanence and which are magnetized perpendicularly to the plane of the plate. A plate (11) of the alloy is fixed between two insulating foils (13, 15) after which this assembly is arranged on a flat backing (17) and is rolled in two mutually perpendicular directions (25, 27) by means of a cylinder (19) whose outer surface is provided with grooves (23). The plate (11) is thus very simply fractured to form a very large number of portions (29).

5 Claims, 3 Drawing Figures

METHOD OF MANUFACTURING A PERMANENT MAGNET WHICH IS TO BE ARRANGED IN AN AIR GAP OF A TRANSFORMER CORE

The invention relates to a method of manufacturing a plate-shaped permanent magnet which is to be arranged in an air gap of a core for a transformer or choke coil and which consists of a number of permanent magnetic portions which are made of a metal alloy having a high magnetic remanence and which are magnetized perpendicularly to the plane of the plate.

German Auslegeschrift No. 24 24 131 discloses a method of this kind where 25 permanent magnets are glued into the air gap of a transformer core one by one. The plate-shaped permanent magnet in the air gap serves to premagnetize the core so that the core is less quickly magnetically saturated during operation. Magnets of a rare earth cobalt alloy or a platinum cobalt alloy are particularly suitable for this purpose because of their high magnetic remanence. It is a drawback of these materials, however, that they are electrically highly conductive so that eddy current losses occur when the plate-shaped magnet is not subdivided into a number of small magnets, as is done according to the known method.

The known method, however, is time consuming even if the permanent magnet is subdivided into a comparatively small number (25) of magnets. The invention has for an object to provide a substantially quicker and hence cheaper method which, moreover, subdivides the plate-shaped magnet into a substantially larger number of portions, resulting in a substantial further reduction of the eddy current losses.

To this end, the method in accordance with the invention is characterized in that a plate of the alloy is fixed between two insulating foils, after which this assembly is arranged on a flat backing and is rolled in two mutually perpendicular directions by means of a cylinder whose outer surface is provided with grooves.

The invention will be described in detail hereinafter with reference to the accompanying diagrammatic drawing in which.

Figure 1:
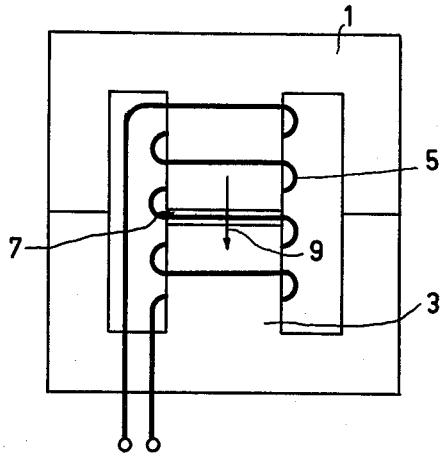
FIG. 1 shows a choke coil.

The choke coil which is diagrammatically shown in FIG. 1 comprises a ferromagnetic core 1 which comprises a central leg 3 around which a winding 5 is provided. The central leg 3 is interrupted by an air gap which accommodates a plate-shaped permanent magnet 7 having a magnetization direction 9 which extends perpendicularly to the plane of the plate. As is described in detail in German Auslegeschrift 24 24 131, the magnet 7 serves to prevent saturation of the core 1 when a current containing a direct current component flows through the winding 5. Said Auslegeschrift also explains that the permanent magent should consist of a number of permanent magnetic portions of a rare earth cobalt or a platinum cobalt alloy in order to achieve a high remanent magnetism and to exhibit at the same time low eddy current losses.

Figure 2:
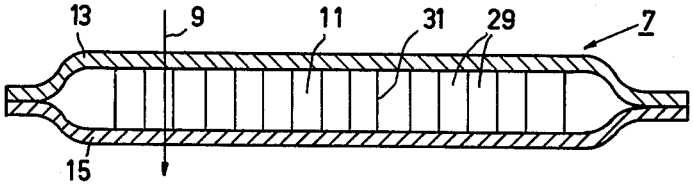
FIG. 2 is a cross-sectional view of a plate-shaped permanent magnet manufactured by means of the method in accordance with the invention.

FIG. 2 shows the permanent magnet 7 manufactured by means of the method in accordance with the invention. This magnet is made of a plate 11 which is magnetized perpendicularly to its plane and which consists of, for example, a samarium cobalt alloy, said plate having a thickness of approximately 150 μm and being fixed between two insulating foils 13 and 15. These foils are made, for example, of a synthetic material which is provided with a layer of glue on one side, the thickness being as small as possible, for example, approximately 15 μm including the layer of glue. Use can alternatively be made of foils without a layer of glue, these foils being connected to each other and to the plate 11 by heating.

Figure 3:
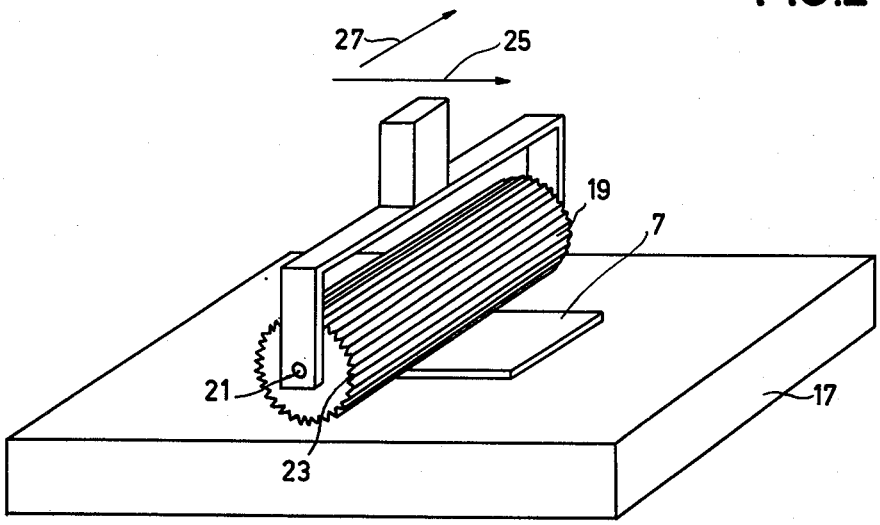
FIG. 3 illustrates the method in accordance with the invention.

After the fixing of the plate 11 between the foils 13, 15, it is broken into a large number of portions in the manner shown in FIG. 3. To this end, it is arranged on a flat, comparatively hard backing 17, for example, a plate of a synthetic material, after which it is rolled by means of a hard, for example, metal cylinder 19, the outer surface of which is provided with a large number of grooves 23 which extend parallel to the cylinder axis 21.

The cylinder 19 has a diameter of, for example, from 5 to 15 mm, the centre-to-centre distance of the grooves amounting to approximately 0.5 mm. The grooves may alternatively extend in a different direction, for example, circumferentially of the cylinder. The cylinder 19 is first moved across the magnet 7 in the direction of the arrow 25, and subsequently it is turned through 90° and moved across the magnet again in the direction of the arrow 27. The plate 11 is thus broken into a larger number (for example, approximately 1000) of portions 29 (see FIG. 2).

The electrical resistance across a fracture line 31 between two adjoining portions 29 is comparatively high so that virtually no eddy currents can flow in the magnet 7. The magnetization direction 9 of each portion 29 is the same as the magnetization direction of the original plate 11, due to the fact that the portions remain fixed between the foils 13, 15.

The permanent magnet 7 thus formed can be readily mounted in the air gap of the core 1.

What is claimed is:

1. A method of manufacturing a plate-shaped permanent magnet which is to be arranged in an air gap of a core for a transformer or choke coil and which includes a number of permanent magnetic portions which are made of a metal alloy having a high magnetic remanence and which are magnetized perpendicularly to the plane of the plate, the method comprising the steps of fixing and attaching a plate of the alloy between two insulating foils to form a sandwich assembly in which the magnetic plate is attached to the two insulating foils, arranging this assembly on a flat backing and rolling a cylinder whose outer surface is provided with grooves over said assembly in two mutually perpendicular directions to break the plate into a number of permanent magnetic portions.

2. A method as claimed in claim 1, characterized in that the grooves in the outer surface of the cylinder extend parallel to the cylinder axis.

3. A method of making a plate-shaped permanent magnet assembly including a plurality of permanent magnet elements magnetized perpendicular to the plane of the plate by means of a rotatable cylinder having an outer surface provided with grooves comprising the steps of attachably fixing a plate made of an electrically conductive alloy material having a high magnetic remanence and magnetized perpendicular to the plane of the plate between two foils of insulating material to form a sandwich assembly, and sandwiching said assembly between a flat backing surface and said cylinder and imparting relative motion between the cylinder and assembly in a first direction and then in a second perpendicular direction such that the cylinder effectively rolls across the surface of the assembly in two mutually perpendicular directions with sufficient pressure being applied to break the alloy material into a plurality of permanent magnet elements magnetized perpendicular to the plane of the plate-shaped assembly.

4. A method as claimed in claim 3 wherein the grooves on the outer surface of the cylinder extend parallel to the cylinder axis and said insulating foils each comprise a layer of synthetic material provided with a layer of glue on the surface to be attached to the alloy plate.

5. A method as claimed in claim 3 wherein each of said insulating foils comprise a synthetic material that adheres to the alloy plate under heat, and wherein the fixing step includes heating said foils to attach them to the alloy plate.

* * * * *